United States Patent [19]

Howe et al.

[11] 4,025,259

[45] May 24, 1977

[54] APPARATUS FOR THE PRODUCTION OF PREFABRICATED BUILDING COMPONENTS SUCH AS WALL ELEMENTS, ROOM CELLS OR THE LIKE CLAD WITH CERAMIC PLATES

[76] Inventors: Harald Howe, Donauweg 11, Junkersdorf, Germany, D-5022; Klaus Goldner, Waldstrasse 31, Traunricht, Germany, D-8472

[22] Filed: Mar. 15, 1976

[21] Appl. No.: 666,762

Related U.S. Application Data

[62] Division of Ser. No. 516,614, Oct. 21, 1974, abandoned.

[52] U.S. Cl. ..... 425/123; 425/110; 425/405 R

[51] Int. Cl.[2] ..... B28B 23/22

[58] Field of Search ..... 249/83; 425/17, 18, 425/19, 32, 405 R, 405 H, 110, 123, 127

[56] References Cited

UNITED STATES PATENTS

| | | | |
|---|---|---|---|
| 2,513,785 | 7/1950 | Browne | 425/DIG. 44 |
| 2,855,653 | 10/1958 | Kastenbein | 425/110 |
| 3,315,327 | 4/1967 | McClarney | 249/83 X |
| 3,635,623 | 1/1972 | Olson et al. | 425/123 |
| 3,751,201 | 8/1973 | Kelsey | 425/123 |
| 3,833,694 | 9/1974 | Hughes | 425/405 R X |
| 3,891,178 | 6/1975 | Kelsey | 425/123 X |
| 3,895,985 | 7/1975 | Schelkmann | 425/405 R X |
| 3,920,498 | 11/1975 | Everhardt et al. | 425/32 X |

*Primary Examiner*—J. Howard Flint, Jr.
*Attorney, Agent, or Firm*—Andrus, Sceales, Starke & Sawall

[57] ABSTRACT

Ceramic plates are held by suction against a mat with holes corresponding to the plates and then concrete is cast on them. In order to aid bringing the plates into air-tight engagement with the mat, a flexible sheet is temporarily laid over the plates and then later removed.

7 Claims, 1 Drawing Figure

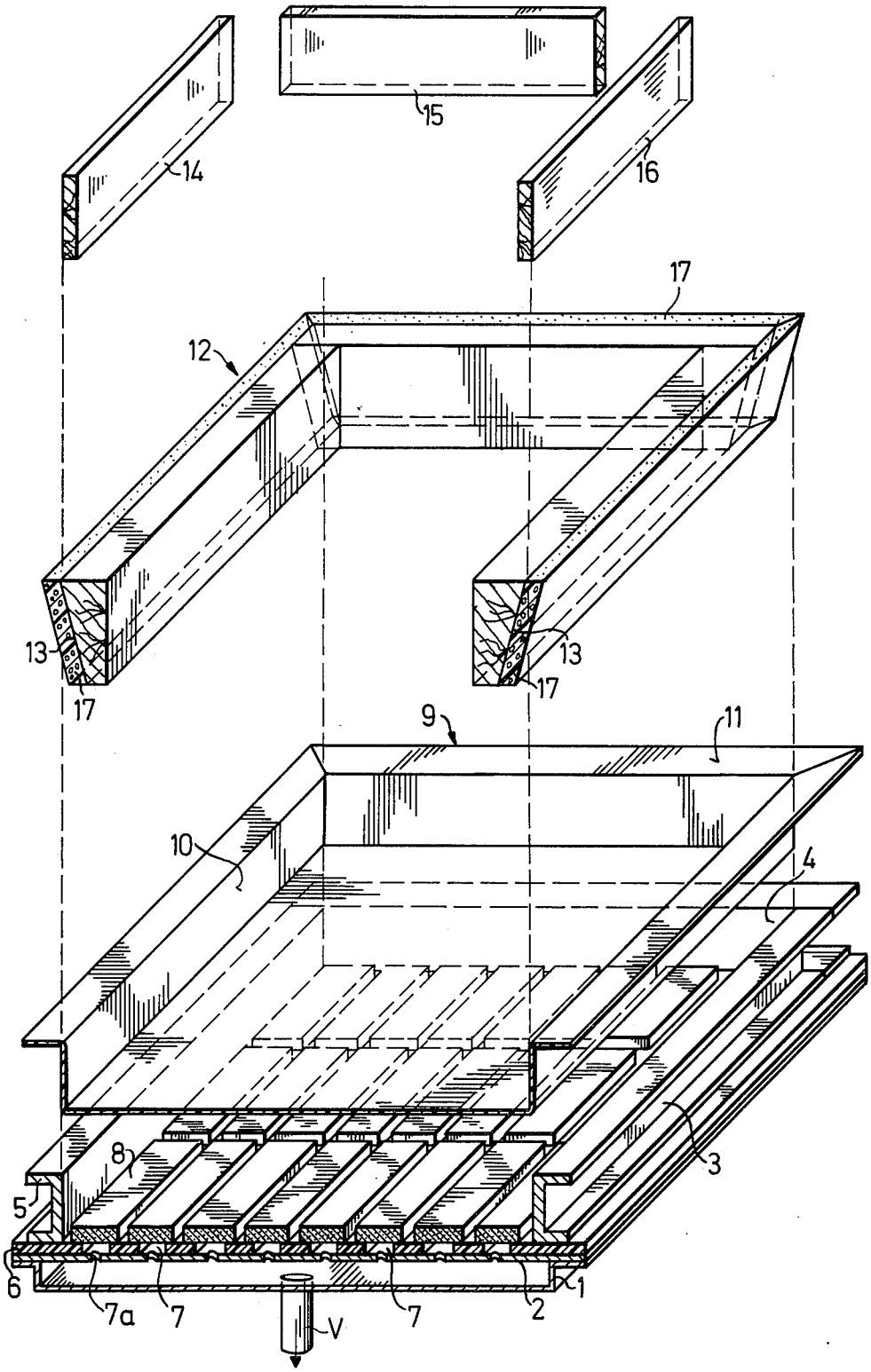
15
14
16
17
12
13
17
13
17
9
11
10
4
3
8
5
6
7a
7
V
7
2
1

APPARATUS FOR THE PRODUCTION OF PREFABRICATED BUILDING COMPONENTS SUCH AS WALL ELEMENTS, ROOM CELLS OR THE LIKE CLAD WITH CERAMIC PLATES

CROSS REFERENCE TO RELATED APPLICATION

This application is a divisional application of copending application, Ser. No. 516,614, filed Oct. 21, 1974, now abandoned.

BACKGROUND OF INVENTION

1. Field to which invention relates

The present invention relates to apparatus for the production of prefabricated building components such as wall elements, room cells or the like clad with ceramic plates, in the course of which material which later hardens, preferably concrete, is cast on the ceramic plates, laid in an enclosure or shuttering in a predetermined pattern and having there rear sides turned towards the material which hardens.

2. The Prior Art

The U.S. Pat. Spec. No. 2,855,653 refers to a method in which, using available technical means, multiple ceramic plates, more especially split tiles or plates, can be applied simply and cheaply to prefabricated constructional components such as wall elements, room cells or the like, and in this method there is the possibility of producing any desired form of shape or structure and furthermore, in accordance with the term prefabrication, no subsequent operations are necessary and more particularly it is not neccesary to point the joints.

In this respect the U.S. Pat. Spec. No. 2,855,653 mentions carrying out the technique in such a manner that the ceramic plates are laid on a mat which consists of elastic material and which is supported by a perforated plate of material which keeps its shape, over openings corresponding to the size of the plates on the connecting pieces left remaining between the openings and by means of suction which is caused to act via the holes in the plate the ceramic plates are drawn against the mat.

SUMMARY OF INVENTION

One aim of the present invention is to provide a further development of this technique and to ensure that the holding by suction of the individual plates on the mat is carried out as rapidly and effectively as possible.

In order to achieve this and other aims, the invention proposes that over the ceramic plates, laid in position, and the edges of the shuttering, an air-tight sheet or strip is placed and on application of the vacuum via the holes in the perforated plate the ceramic plates are drawn by suction onto the mat and the sheet is drawn onto the rear side of the ceramic plates and the shuttering walls.

With this feature the air space to be evactuated is substantially reduced in size, something which leads to a shortening of the operation concerned.

If the ceramic plates lie in a sealing manner on the mat, the air-tight sheet is released in the shortest possible time and can easily be removed, following which then in a conventional manner the application of the material, which later hardens, preferably concrete, is seen too.

Preferably use is made of a sheet which is constructed in the form of a trough and having peripheral dimensions corresponding to the inner shape of the shuttering. In this respect the corners are conventiently cemented or welded and on all sides a projecting rim extending beyond the shuttering walls is provided for.

In accordance with a further development of the invention there is the provision of a frusto-pyramidal frame which on oblique outer surfaces is covered with an elastic material, for example cellular rubber, and this frame is inserted above the air-tight sheet before the application of the vacuum in the shuttering. As a result the pressing on on all sides of the air-tight sheet against the shuttering and therefore the air-tight closure of the space to be evacuated is facilitated.

In the simplest case this effect can be obtained also by drawing tight the air-tight sheet in the shuttering using shuttering boards suitably cut to size, which if necessary can also be used for further fixation of a frame clad with the elastic cushion.

DESCRIPTION OF PREFERRED EMBODIMENTS

The accompanying drawing shows a single FIGURE a device of the present invention, in the case of which in the upper part as alternatives a frame, and rspectively, shuttering boards to be inserted for fixing the air-tight sheet are indicated. Considering the drawing it will be seen that reference numeral 1 considers an air box, which is connected with a suitable force of suction or vacuum. On it there is placed a steel plate 2, which forms part of the enclosure or shuttering, which after insertion of the ceramic plates has a hardening material, for example concrete, cast in it. The other shuttering parts are formed by the U-girders 3, 4, 5 with their webs upright. The front part of the arrangement is cut away to make its interior visible. On the steel plate 2 a mat 6 of elastic material is laid, which as suitable openings 7. The openings 7 expose holes in the steel plate 1. The ceramic plates 8 are so placed above the openings 7 that the edge zones of these ceramic plates lie on the edges surrounding the openings 7. In this respect the ceramic plates 8 can be aligned in a suitable manner with respect to each other.

Over the laid out ceramic plates a sheet 9 of an air-tight material as for example artificial leather, a thick PVC-foil or the like is laid, which in the case of the embodiment shown has bent up side arts 10 and outwardly extending projecting flanges 11, which have been produced by suitable folding and joining of the sheet. This sheet is fixed with the help of the frame 12 in the shuttering, which has chamfered outer sides 13, which are covered with an elastic material 17 of for example cellular rubber or foam rubber. The frame 12 can be made of wood, plastic or the like but also of metal and preferably light metal alloy.

In the upper part of the drawing an alternative construction in the form of shuttering boards 14, 15, 16, cut to the right size, is indicated. These boards can also serve for holding the sheet 9 in the shuttering, but in addition can be used for stiffening and making fast the frame 12.

When the air box 1 is connected with vacuum, if the mat 6 is completely covered with ceramic plates, the plates are drawn downwards. The air space from which air has to be withdrawn is considerably reduced by the sheet 9, because on building up the vacuum the sheet lies against the side girders 3, 4, 5 and on the rear sides of the laid out ceramic plats. When the ceramic plates 8 are firmly laid against the mat 6, the build-up of the vacuum under the sheet between the latter and rear side of the ceramic plates stops and the sheet can easily be removed. The casting of the material which later hardens, on the ceramic plates is now carried out.

Various modes of carrying out the invention are contemplated as being within the scope of the following claims particularly pointing out and distinctly claiming the subject matter which is regarded as the invention.

We claim:

1. Apparatus for the production of prefabricated building components formed of a cementitious material clad with ceramic plates, said apparatus comprising:

a form having a peripheral wall;

a base plate in said form surrounded by said wall and having a plurality of holes at spaced locations, said base plate being connected to a source of vacuum for applying a vacuum to said holes;

an elastic mat mounted on said base plate within said form, said mat having holes aligned with the holes of said base plate and being suitable for receiving the ceramic plates over said holes for subjecting them to the vacuum; and a trough-shaped impervious sheet having a bottom portion positionable over said mat on the exposed surface of the plates and a peripheral wall portion sealable to said peripheral wall of said form in an air-tight manner, said sheet being formed of highly flexible material for embracing the exposed surface of each of said plates and reducing the volume of spaces between the plates responsive to the application of a vacuum to said holes.

2. The apparatus according to claim 1 wherein said peripheral wall portion is joined together at the corners.

3. The apparatus according to claim 1 wherein said sheet includes outwardly extending flanges mounted on the exposed edges of said wall portion for engaging said form.

4. The apparatus according to claim 1 further including a frame insertable within the wall portion of said sheet for forcing said sheet into engagement with the wall of said form for providing the air-tight seal.

5. The apparatus according to claim 4 wherein said frame includes a plurality of external surfaces converging toward said base plate, said surfaces being covered with an elastic material.

6. The apparatus according to claim 4 wherein said frame means includes a plurality of board insertable within said sheet adjacent the wall portion of said sheet.

7. The apparatus according to claim 4 wherein said frame includes a plurality of boards coacting with said frame for providing an air-tight seal between said sheet and said form.

* * * * *